United States Patent [19]

Morishita et al.

[11] Patent Number: 5,038,626

[45] Date of Patent: Aug. 13, 1991

[54] PINION SHIFTING ARRANGEMENT FOR A STARTER

[75] Inventors: Akira Morishita; Keiichi Konishi, both of Himeji, Japan

[73] Assignee: Mitsubishi Denki Kabushiki Kaisha, Tokyo, Japan

[21] Appl. No.: 452,483

[22] Filed: Dec. 19, 1989

[30] Foreign Application Priority Data

Dec. 19, 1988 [JP] Japan ..... 63-321565

[51] Int. Cl.[5] ..... F02N 11/00

[52] U.S. Cl. ..... 74/6; 74/7 A; 123/179 M

[58] Field of Search ..... 74/6, 7 R, 7 A; 123/179 M; 290/83

[56] References Cited

U.S. PATENT DOCUMENTS

| | | | |
|---|---|---|---|
| 2,010,265 | 8/1935 | Kauffman | 74/7 A |
| 3,223,863 | 12/1965 | Preece et al. | 74/7 A |
| 4,262,546 | 4/1981 | Mazzorana | 74/7 A |
| 4,356,735 | 11/1982 | Bögner et al. | 74/7 A |
| 4,573,364 | 3/1986 | Givan | 74/7 E |
| 4,677,407 | 6/1987 | Tanaka et al. | 335/202 |

FOREIGN PATENT DOCUMENTS

| | | | |
|---|---|---|---|
| 951323 | 10/1956 | Fed. Rep. of Germany | 74/7 A |
| 1218799 | 6/1966 | Fed. Rep. of Germany | 74/7 A |
| 2117937 | 7/1972 | France . | |
| 859461 | 1/1961 | United Kingdom | 74/7 A |
| 7900073 | 2/1979 | World Int. Prop. O. . | |

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

A starter pinion shifting arrangement comprising a solenoid switch having a hook which can be pulled by a plunger which can be electromagnetically actuated through a compression spring, and a shift lever connected between the hook and a sliding thrust and a pinion movement unit slidably mounted on a support shaft and including a pinion engageable with a driven gear. A clearance is provided through which the hook can be pulled by the plunger when the hook is in a stopped position when the pinion is in a stopper abutting position in which the pinion moved by the attraction toward a stationary core of the plunger is in engagement with the driven gear. An elastic member, which is flexed through said shift lever by the compression force of the compression spring when it is flexed as the pinion movement unit is in the stopper abutting position in which the pinion is in engagement with the driven gear, may be disposed in an engagement portion between the shift lever and the pinion movement unit. The compression spring may comprise two parallel mounted springs, the two compression springs act to urge the pinion to the driven gear when the pinion is in abutment with the driven gear, and only one of the two compression springs acts when the pinion is in the stopper abutting position in which the pinion is in engagement with the driven gear.

3 Claims, 6 Drawing Sheets

PINION SHIFTING ARRANGEMENT FOR A STARTER

BACKGROUND OF THE INVENTION

This invention relates to a pinion shifting arrangement and, more particularly, to a shift mechanism for sliding a pinion for transmitting a drive force to an engine ring gear in an engine starter for starting an automotive engine, for example.

Heretofore, a starter motor for starting an automotive internal combustion engine as illustrated in FIG. 1 has already been well-known.

The conventional starter motor 1 shown in FIG. 1 comprises a d.c. motor 2, a pinion movement unit 3 slidably mounted on an extension (called output rotary shaft hereinafter 2*a* of the armature rotary shaft extending in an axially front (the right side as viewed in FIG. 1) direction from the armature of the d.c. motor 2, a solenoid switch unit 4 mounted on a side portion of the d.c. motor 2, and a shift lever 5 for slidably shifting the pinion movement unit 3.

The solenoid switch unit 4 comprises a cylindrical case 6 having a wall 6*a* at one end, and a cylindrical bobbin 8 on which an excitation coil 7 wound around the outer circumference thereof is disposed. A sleeve 9 is inserted into the inside of the bobbin 8, and the front end of the sleeve 9 is fitted and extends through a central opening of the wall 6*a* of the case 6 and is forwardly open. Within the front end side of the sleeve 9, a movable plunger 10 is disposed, and a stationary core 11 is disposed in opposition to the plunger 10 at the rear end side of the sleeve 9. A return spring 12 is disposed between the plunger 10 and the stationary core 11, so that the plunger 10 is returned to its original position when the excitation coil 7 is deenergized.

The central portion of the stationary core 11 has formed therein a through hole, into which a rod 13 is slidably inserted with its one end projecting therefrom by a predetermined distance toward the plunger 10, and with its the other end having supported thereon a movable contact 14. Also, in the plunger 10 which can be attracted and moved toward the stationary core 11, a recessed portion 10*a* which is axially outwardly open is formed, and a piston-shaped hook 15 having formed on its rear end a flange portion 15*a* is slidably inserted. This hook 15 outwardly projects through the central hole of a holder 16 which closes the open end of the recessed portion 10*a*, and the projecting end thereof has engaged thereto an upper end 5*a* of the shift lever 5. A compression spring 17 which comprises a cylindrical coil spring is disposed between the holder 16 and the flange portion 15*a* of the hook 15 within the recessed portion 10*a* of the plunger 10.

Further, reference numeral 18 indicates a cap made of a resin, and 19 indicates a terminal bolt mounted to the cap 18 and having a stationary contact 19*a* engageable with the movable contact 14 at its inner end.

On the other hand, the pinion movement unit 3 comprises an over-running clutch assembly 20 and a pinion 21 formed integrally with a clutch inner member of the over-running clutch assembly 20. A tubular portion 22 is integrally formed on the rear portion of the clutch outer member, and the inner circumferential surface of the tubular portion 22 has formed therein splines for engaging with helical splines formed in the outer circumference of the output rotary shaft 2*a*. The tubular portion 22 also has on its outer circumference a lever engagement mechanism 23 with which a forked lower end portion 5*b* of the shift lever 5 is engaged. The lever engagement mechanism 23 comprises a cylindrical stationary engagement ring 24 and a cylindrical movable engagement ring 25, the stationary engagement ring 24 having a radially inwardly projecting front end flange portion 24*a* and a radially outwardly projecting rear end flange portion 24*b*. The front end flange portion 24*a* of the stationary engagement ring 24 is placed over the tubular portion 22 and is secured onto the rear wall of the clutch outer member by a stop ring. Also, the movable engagement ring 25 is slidably fitted over the outer circumference port on of the stationary engagement ring 24, and has a radially outwardly extending flange portion 25*a* only on the front end. Between the flange portion 25*a* and the rear wall of the clutch outer member, a conical spring washer 26 is disposed. The forked lower end portion 5*b* of the shift lever 5 is disposed within the circumferential groove defined between the flange portions 24*b* and 25*a* of the engagement rings of the lever engagement mechanism 23 to mount or ride on the mechanism 23, thereby to engage at its front and rear end faces with the flange portions 24*b* and 25*a*.

Next, the operation of the conventional starter apparatus as above described will now be briefly described.

When the key switch of the vehicle is turned on, the excitation coil 7 of the solenoid switch unit 4 is energized to generate a magnetic force which attracts the plunger 10 toward the core 11. As the plunger 10 moves the shift lever 5 is rotated and causes the pinion movement unit 3 to slide over the output rotary shaft 2*a*. At this time, when the pinion 21 abuts against the side surface of an engine ring gear, the rotation of the shift lever 5 is stopped but the plunger 10 is kept moving by the magnetic attraction to compress the compression spring 17. This charged spring energy of the compression spring 17 is a force which urges the pinion against the engine ring gear through the shift lever 5.

Then, due to the movement of the rod 13 pushed into the stationary core 11 upon the abuttment of the plunger 10 against the stationary core 11, the movable contact 14 engages the stationary contact 19*a*, whereby the power source is connected to the d.c. motor 2. As a result, the output rotary shaft 2*a* rotates and its rotational force is transmitted to the pinion 21 through the over-running clutch unit 20. Thus, the pinion 21 engages the engine ring gear as soon as it starts to be rotated and is moved by the spring force of the compression spring 17 over the entire stroke (a sliding movement to the engagement position in which the front end of the pinion 21 abuts against a stopper 27 to come to a stop), and the compression spring 17 causes the movable engagement ring 25 to shift at the time the hook 15 abuts against the bottom wall of the recessed portion 10*a* of the plunger 10, thereby applying an urging force to the conical spring washer 26 through the shift lever 5 to flex it. The conical spring washer 26 thus flexed functions to urge the pinion movement unit 3 against the stopper 27 while the starter apparatus 1 is being operated.

However, in the conventional starter apparatus, the wear of the lower end portion 5*b* of the shift lever 5, the wear of a stopper 27 or a stopper ring 28, or the wear of the groove in which the stopper ring 28 is inserted cause the conical spring washer 26 to be inactive (non-flexible), making it impossible to urge the pinion movement unit 3 against the stopper 27.

The fact that the pinion movement unit 3 cannot be urged against the stopper 27 means that the pinion movement unit 3 can axially freely move during the operation between the lower end portion 5*b* of the shift lever 5 and the stopper 27, therefore when the pinion 21 transmits the rotational force to the ring gear, the pinion movement unit 3 is moved toward the stopper 27 due to the function of the helical spline, and when the rotational force is transmitted reversely from the engine to the pinion 21 due to change in engine rotation, the pinion movement unit 3 is moved toward the shift lever lower end 5*b*. Therefore, during the operation of the starter apparatus, the pinion movement unit 3 is fiercely moved back and forth, generating noise and exerting large impacts to various components, and the contact between the gear teeth of the ring gear and the pinion is intermittent and not continuous, resulting in damages in the pinion or the ring gear or other parts at an early stage.

SUMMARY OF THE INVENTION

Accordingly, one object of the present invention is to provide a pinion shifting arrangement for a starter free from the above discussed problems of the conventional design.

Another object of the present invention is to provide a pinion shifting arrangement for a starter in which the pinion movement unit can be urged against the stopper for an extended period of time thereby preventing the pinion movement unit from axially ratting back and forth at an early stage.

With the above objects in view, the pinion shifting arrangement of the present invention is characterized by comprising solenoid switch means having a hook which can be pulled in the axial direction by a plunger which can be electromagnetically actuated through a compression spring; and a shift lever having one end thereof engaged with the hook and the other end thereof for applying a sliding thrust force to a pinion movement unit slidably mounted on a support shaft and including a pinion engageable with a driven gear to be driven; and a clearance is provided through which the hook can be pulled by the plunger when the hook is in a stopped position when the pinion is in a stopper abutting position in which the pinion moved by the attaraction toward a stationary core of the plunger is in engagement with the driven gear.

Also, the pinion shifting arrangement of the present invention is further characterized in that, in addition to the above first features, an elastic member, which is flexed through said shift lever by the compression force of the compression spring when it is flexed as the pinion movement unit is in the stopper abutting position in which the pinion is in engagement with the driven gear, is disposed in an engagement portion between the shift lever and the pinion movement unit.

Further, the pinion shifting arrangement of the present invention is further characterized in that, in addition to the above first features, the compression spring comprises two parallel mounted springs, the two compression springs act to urge the pinion to the driven gear when the pinion is in abutment with the driven gear, and only one of the two compression springs acts when the pinion is in the stopper abutting position in which the pinion is in engagement with the driven gear.

According to the pinion shifting arrangement of the present invention, upon the rotation of the shift lever due to the movement of the attracted plunger, the pinion movement unit finally abuts against the stopper and comes to halt. However, since there is left a space behind the hook within the recessed portion of the plunger, the compression spring remains in a charged state. In other words, the compression spring continues to apply a biasing force to the pinion movement unit for moving it forward (toward the stopper) through the shift lever.

Also, in a pinion shifting arrangement in which the elastic member is disposed in the engagement portion between the shift lever and the pinion movement unit, the elastic member can be flexed in the state in which the hook is permitted to move further rearward within the recessed portion of the plunger (that is, the state in which the compression spring is still compressed), so that the period of time during which the pinion movement unit can be urged against the stopper is determined by not only the rear gap distance behind the hook within the plunger recessed portion but also by the time at which the elastic deformation of the elastic member is removed, making it possible to significantly elongate such time period.

Further, in a pinion shifting arrangement in which two parallel compression springs are provided for exerting a tensile force to the hook within the plunger recessed portion, these two compression springs exert urging forces to the pinion movement unit when the pinion abuts against the engine ring gear, and when the pinion is brought into engagement with the ring gear by the motor rotation (the pinion is moved into the engagement position by the above urging forces), then, thereafter, the pinion movement unit is urged against the stopper only by one of the compression springs.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

The pinion shifting arrangement for a starter of the present invention will now be described in detail in conjunction with its embodiments illustrated in the accompanying drawings.

Figure 1:
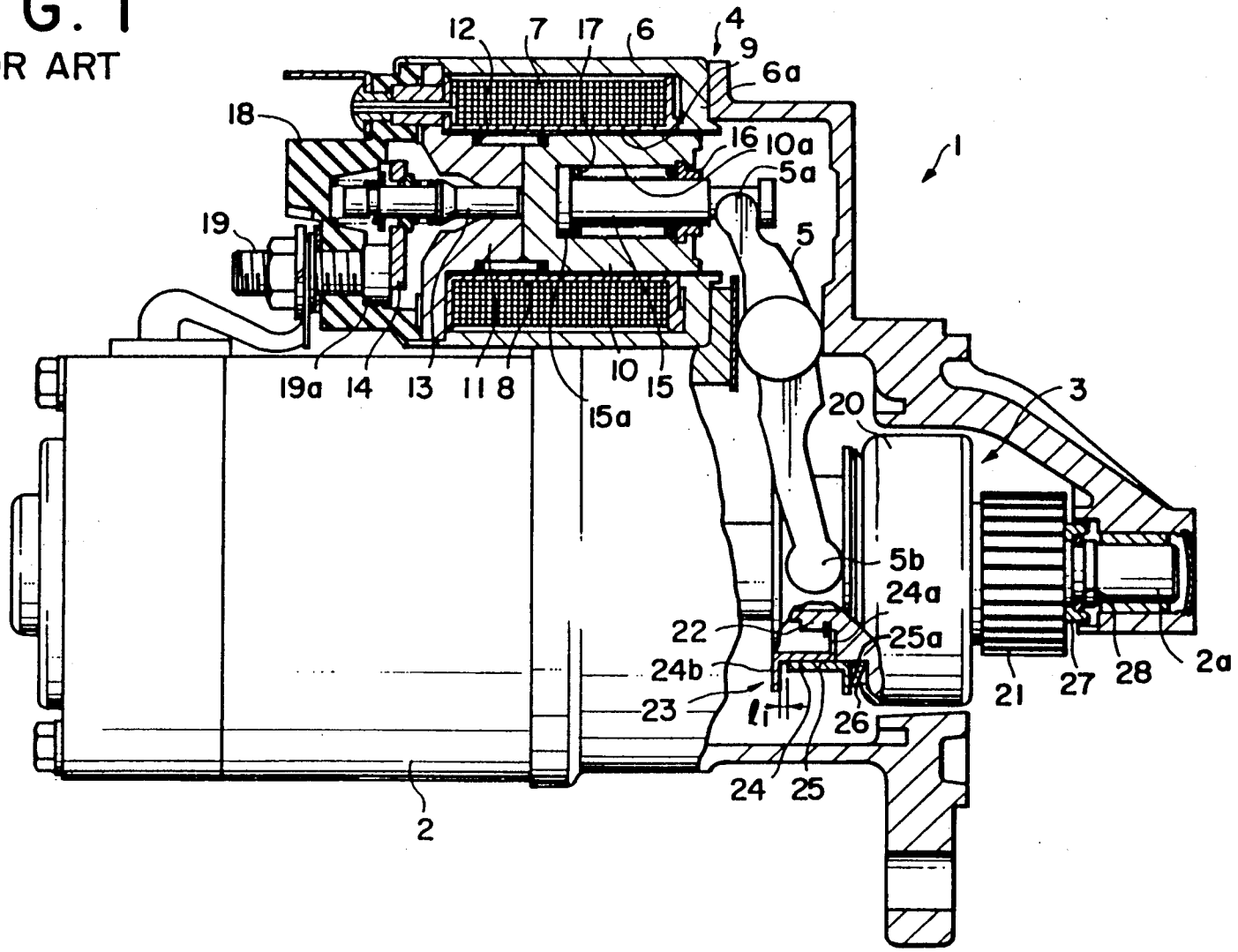
FIG. 1 PRIOR ART
FIG. 1 is a sectional view showing a conventional starter apparatus.
Figure 2:
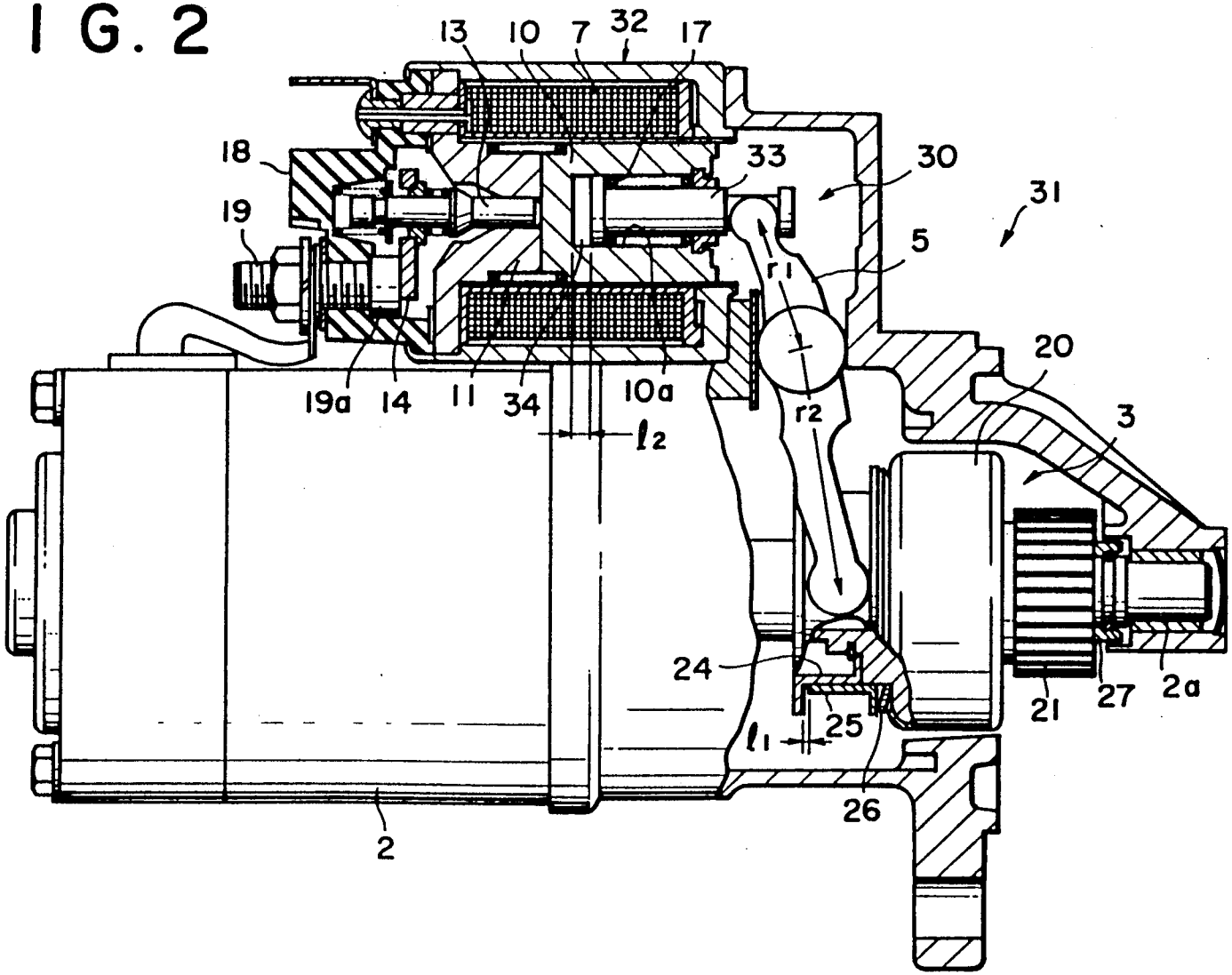
FIG. 2 is a sectional view of the starter apparatus employing the pinion shifting arrangement of the first embodiment of the present invention.

FIG. 2 illustrates a starter apparatus 31 employing a pinion shifting arrangement 30 of the first embodiment of the present invention. In FIG. 2 which shows the starter apparatus 31, the detailed description of the components similar to those of the conventional starter apparatus shown in FIG. 1 to which the same reference characters are assigned will be omitted.

The starter apparatus 31 shown in FIG. 2 comprises a pinion shifting arrangement 30 for slidably moving the pinion movement unit 3, and the shifting arrangement 30 comprises a solenoid switch 32. The solenoid switch 32 is arranged so that a hook 33 mounted within the recessed portion 10*a* of the plunger 10 has an overall length shorter than that of the conventional hook 15 shown in FIG. 1. Therefore, when the plunger 10 is attracted to abut against the stationary iron core 11 and the pinion movement unit 3 is slidably moved to the final projected position at which the pinion movement unit 3 abuts against the stopper 27, the movable engagement ring 25 is pushed by an amount $l_1$ and the conical spring washer 26 is flexed. Under these circumstances, a clearance 34 of the length $l_2$ along which the hook 33 can move is formed behind the hook 33 (the end wall side of the recessed portion 10*a*) within the recessed portion 10*a* of the plunger 10.

Then, the operation of the pinion shifting arrangement 30 of this embodiment as well as the starter apparatus 31 will now be described with reference to FIGS. 3*a* to 3*d*.

Figure 3A:
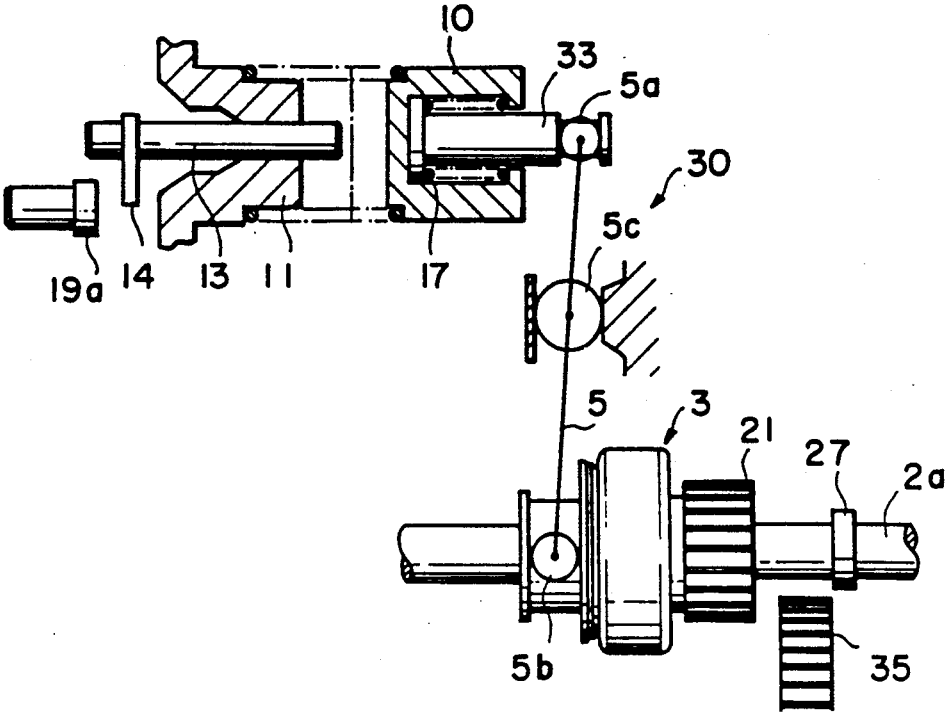
FIGS. 3*a* to 3*d* are schematic diagrams useful for explaining the operation of the starter pinion shifting arrangement shown in FIG. 2.
Figure 3B:
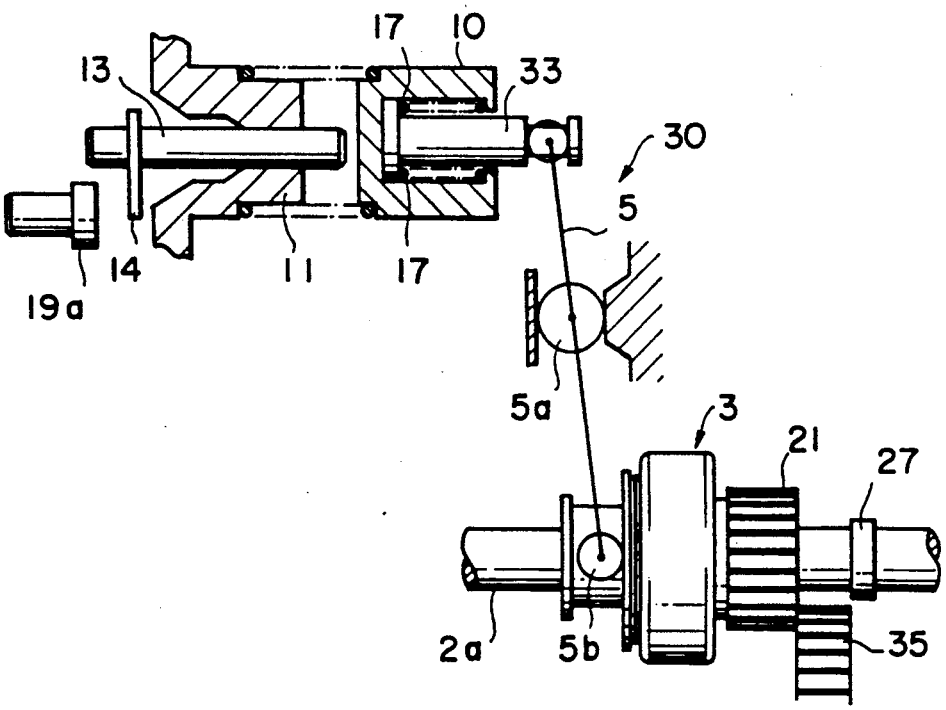

When the key switch of the vehicle is turned on, the excitation coil 7 of the solenoid switch unit 32 is energized to generate a magnetic force which attracts the plunger 10 toward the stater core 11. As the plunger 10 moves the upper end portion 5*a* of the shift lever 5 is pulled to rotate the shift lever 5 about the rocking pivot 5*c* to cause the pinion movement unit 3 to be slidably moved over the output rotary shaft 2*a*, whereby the end face of the pinion 21 abuts against the end face of the engine ring gear 35. The operational positions of the pinion shifting arrangement 30 during the above operation are schematically illustrated in FIGS. 3*a* and 3*b*.

Figure 3C:
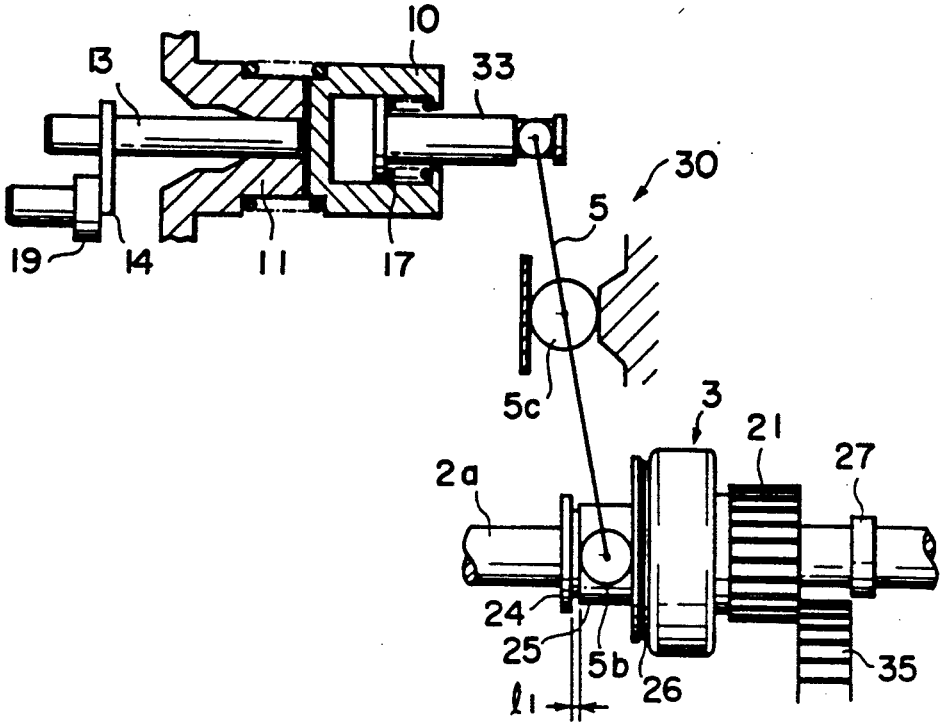

At this time, while the plunger 10 is kept being attracted even after the pinion 21 abuts against the engine ring gear 35, there is generated no rocking motion of the shift lever 5, so that the plunger 10 is moved toward the stationary iron core 11 while compressing the compression spring 17 and maintaining the hook 33 which is in engagement with the upper end portion 5*a* of the shift lever 5 as it is, whereby the rod 13 is pushed and the movable contact 14 mounted thereon is brought into contact with the stationary contact 19*a* (FIG. 3*c*). This charged spring energy of the compression spring 17, which is a force which urges the pinion 21 against the engine ring gear 35 through the shift lever 5, causes the movable engagement ring 25 to be pushed (push distance $l_1$) to flex the conical spring washer 26. Therefore, the shift lever 5 pivots by the corresponding amount although this is a slight amount.

Figure 3D:
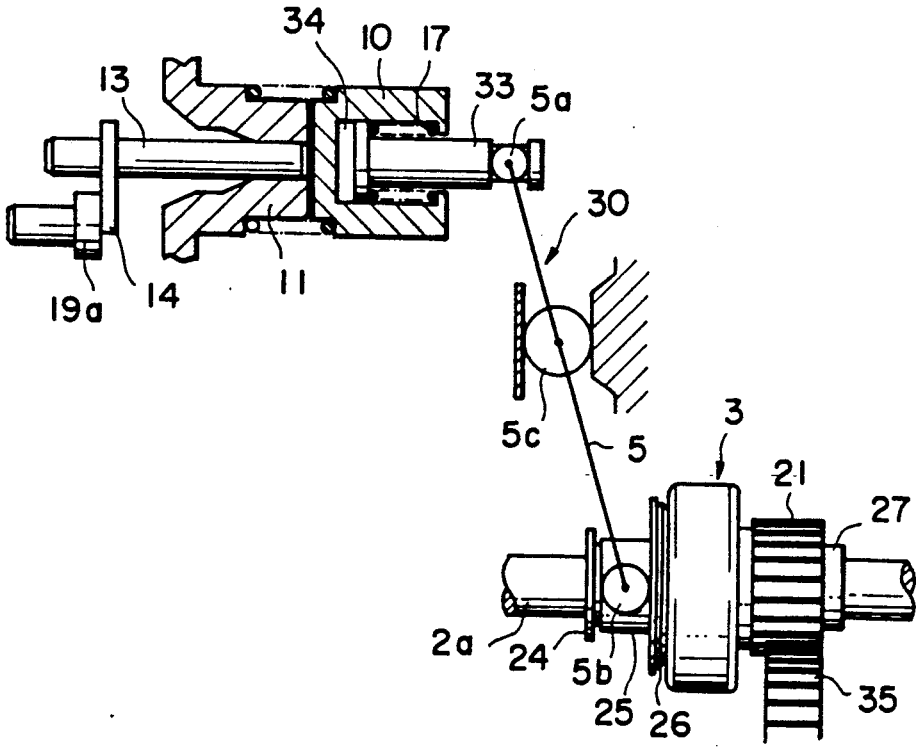

When the movable contact 14 and the stationary contact 19*a* are thus engaged, the d.c. motor 2 is started so that its rotational force is transmitted to the pinion 21 through the over-running clutch unit 20. Thus, since the pinion 21 is urged against the ring gear 35 by the compression spring 17, the pinion 21 is moved by the spring force of the compression spring 17 over the entire stroke (a sliding movement to a predetermined engagement position in which it abuts against the stopper 27) so that the pinion 21 engages the engine ring gear 35 as soon as it starts rotating. That is, the pinion 21 comes to stop at the position in which the hook 33 within the recessed portion 10*a* of the plunger 10 is moved rearward by the force of the compression spring 17 and the pinion movement unit 3 is brought into the aforementioned predetermined engagement position in which it abuts against the stopper 27 or into the final projected position (FIG. 3*d*). During this condition, there is still formed a clearance 34 of the length $l_2$ behind the hook 33 within the recessed portion 10*a* of the plunger 10, and the spring force of the compression spring 17 acts on the hook 33 to continue urging the pinion movement unit 3 against the stopper 27 with the conical spring washer 26 being flexed through the shift lever 5.

With this arrangement, even when wear is generated during the extended period of operation of the starter apparatus 31 at the lower end portion 5*b* of the shift lever 5, at the stopper 27 or the stopper ring 28, or at the groove in which the stopper ring 28 is mounted, the spring action of the compression spring 17 continues exerting force on the pinion movement unit 3 due to the presence of the clearance 34 until the amount of the forward displacement of the pinion movement unit 3 due to the above wear equals to $l_2 \times r_2/r_1$ (where, $r_1$ is a distance between the rocking pivot portion 5*c* and the upper end portion 5*a* of the shift lever 5 and $r_2$ is a distance between the rocking pivot portion 5*c* and the lower end portion 5*b*), and thereafter, the pinion movement unit 3 still continues to be urged by the action of the conical spring washer 26, whereby the pinion movement unit 3 is prevented from axially rattling due to the wear. Thus, no noise is generated and various components including the pinion 21 are not damaged, resulting in a significantly improved durability.

In the above-described first embodiment, the conical spring washer 26 which is an elastic member is disposed at the engagement portion between the lower end portion 5*b* of the shift lever 5 and the pinion movement unit 3 so that the conical spring washer 26 continues to exert an urging force even after the spring action of the compression spring 17 has disappeared. However, the continuous urging can be realized only by the compression spring 17 without the conical spring washer 26 as described previously.

Figure 4:
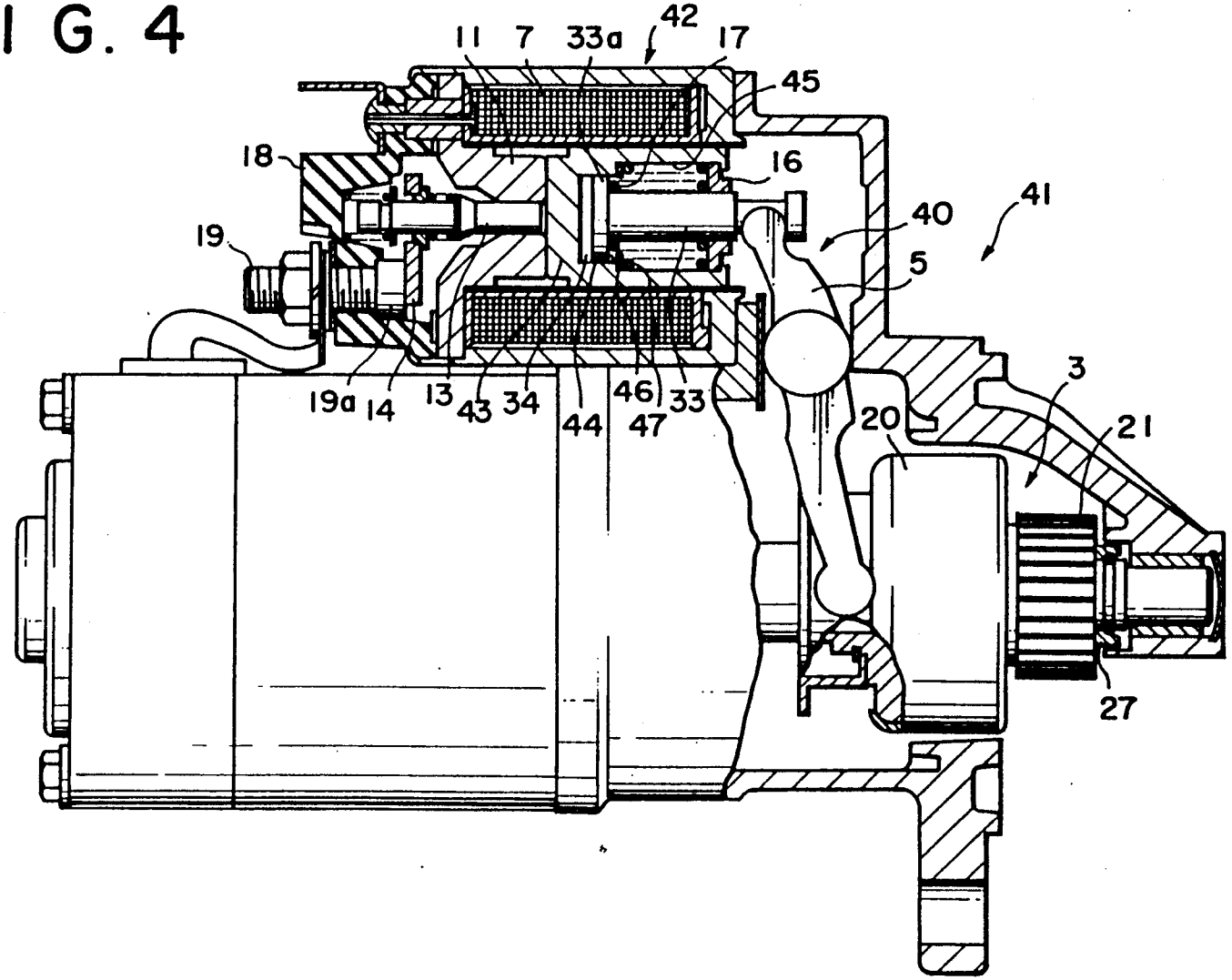
FIG. 4 is a sectional view of the starter apparatus employing the pinion shifting arrangement of the second embodiment of the present invention.

FIG. 4 illustrates a starter apparatus 41 comprising a pinion shifting arrangement 40 of the second embodiment of the present invention and with no provision of a conical spring washer.

The pinion shifting arrangement 40 of the starter apparatus 41 includes a solenoid switch 42 as well as the shift lever 5. The solenoid switch 42 is arranged so that a plunger 43 is provided with an axially outwardly open recessed portion 44 within which the hook 33 is slidably disposed. The recessed portion 44 has formed therein a large-diameter portion 45 extending by a predetermined length from the open side. At the step portion between the rear end portion (the left side as viewed in FIG. 4) of the large-diameter portion 45 formed in the inner circumference of the recessed portion 44 and the recessed portion 44, a ring plate 46 is axially slidably disposed within the large-diameter portion 45. The inner diameter of the ring plate 46 is smaller that that of the recessed portion 44, so that the ring plate 46 projects radially inwardly of the inner circumference of the recessed portion 44. Therefore, when the hook 33 moves forward while opposing to the plunger 43, the rear end flange portion 33*a* of the hook 33 engages the inner circumference of the ring plate 46 to slide it forward. Between the ring plate 46 and the holder 16, a second compression spring 47 as opposed to the first compression spring 17 is disposed, so that the second compression spring 47 is compressed by the sliding movement of the ring plate 46 due to the relative forward movement of the hook 33 as previously described.

The operation of the starter apparatus 41 constructed as above described will now be described in detail with reference to FIGS. 5*a* and 5*b*.

The description of the operation from the turning on of the vehicular key switch untill the pinion movement unit 3 slides and causes the pinion 21 to abut against the engine ring gear 35 will be omitted because it is the same as that illustrated in FIGS. 3*a* and 3*b*.

Figure 5A:
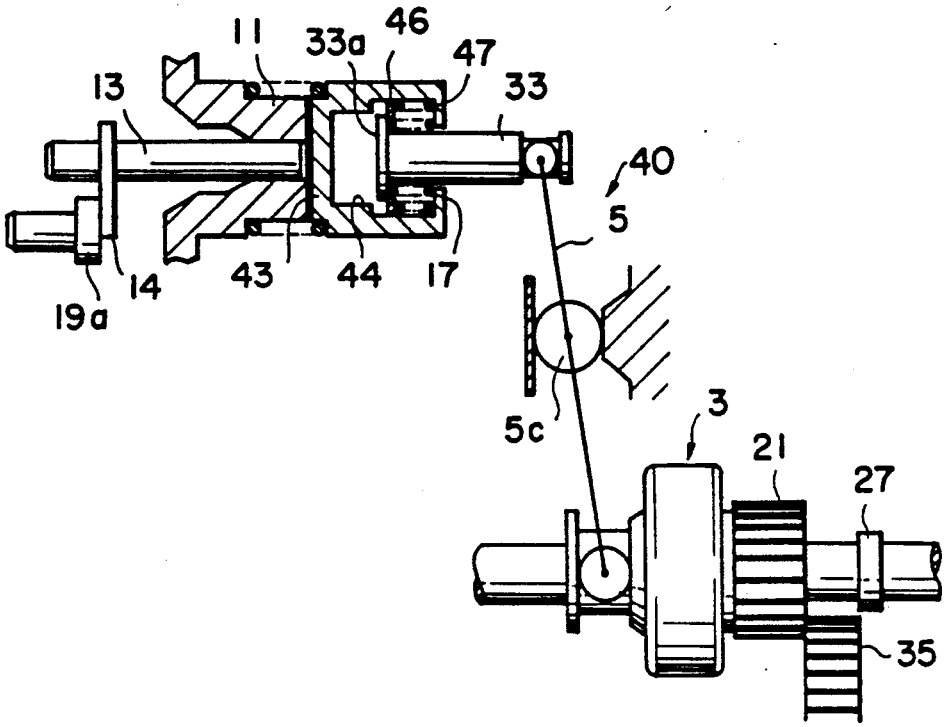
FIGS. 5*a* and 5*b* are schematic diagrams useful for explaining the operation of the starter pinion shifting arrangement shown in FIG. 4.
Figure 5B:
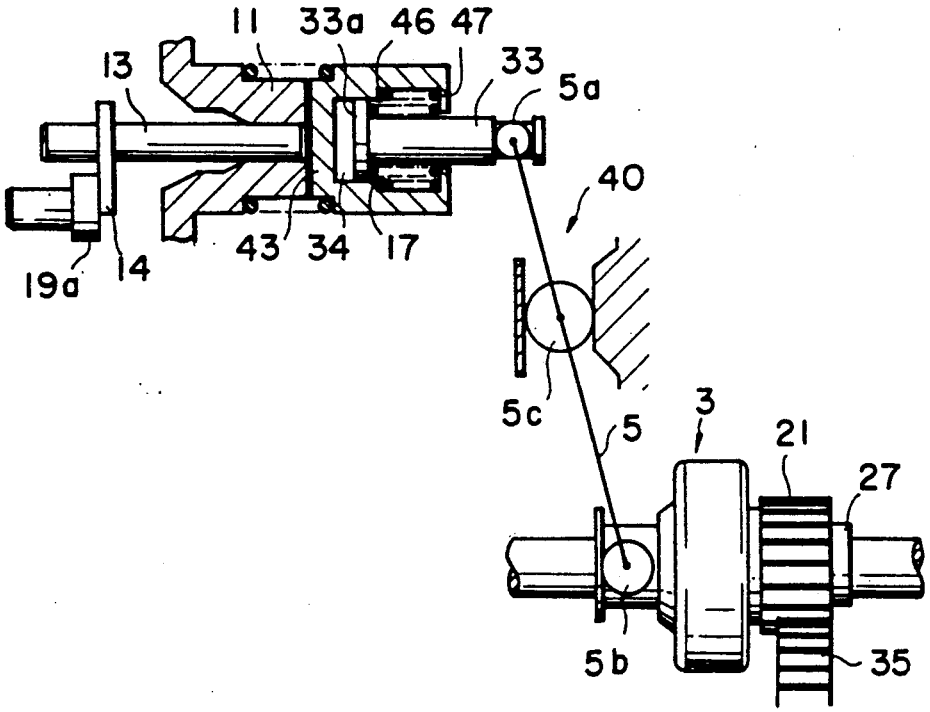

While the plunger 43 continues to be attracted even after the pinion abuts the ring gear 35, since the hook 33 connected to the shift lever 5 is not allowed to move, the hook 33 is moved relatively forward as shown in FIG. 5*a*, resulting in the compression of the second compression spring 47 together with the first compression spring 17 by the movement of the ring plate 46. As a result, a massive biasing force by the first and the second compression springs 17 and 47 acts on the pinion movement unit 3 through the shift lever to urge the pinion 21 against the ring gear 35.

When the d.c. motor 2 starts rotating due to the engagement of the movable contact 14 with the stationary contact 19*a*, the pinion movement unit 3 is moved through its entire stroke by the spring forces of the two compression springs 17 and 47 until it abuts against the stopper 27. When the pinion movement unit 3 reaches its fully moved position, the rear end flange portion 33*a* of the hook 33 is positioned within the recessed portion 44 beyond the stepped portion defined at the rear end of the large-diameter portion 45 or between the recessed portion 44 and the large-diameter portion 45 (in other words, the axial length of the large-diameter portion 45 is determined to provide this condition), and therefore the spring action of the second compression spring 47 is eliminated as the ring plate 46 abuts against the stepped portion. Thus, after the pinion 21 abuts against the stopper 27, the spring action of the first compression spring 17 alone is intermittently applied to the pinion movement unit 3 to urge it against the stopper 27 through the hook 33 and the shift lever 5 only while the hook 33 is permitted to move within the clearance 34 in the recessed portion 44. Therefore, a massive urging force is applied in the engagement waiting state in which the pinion 21 is in abutment against the ring gear 35, and a weaker urging force is applied when the pinion 21 is in engagement with the ring gear 35 and in abutment against the stopper 27.

In the pinion shifting arrangements 30 and 40 of the first and the second embodiments of the present invention as above described, the length of the hook 33 is made short so that the clearance 34 is formed at the hook rear end side within the recessed portion of the plunger when the pinion 21 of the pinion movement unit 3 is in the fully moved position in which it is in abutment with the stopper 27. However the position of the stationary iron core 11 may be rearwardly displaced to increase the length of the stroke of the plunger, or the length of the recessed portion may be increased.

As has been described, according to the pinion shifting arrangement for a starter of the present invention, a clearance is provided through which the hook is allowed to further move beyond the stop position of the hook within the recessed portion of the plunger when the the pinion of the pinion movement unit stops in a position at which it engages with the driven gear such as the engine ring gear, so that the compression spring, which exerts an urging force against the driven gear when the pinion of the pinion movement unit abuts against the driven gear, may be utilized to intermittently urge the pinion movement unit at the fully moved position against the stopper. Therefore, the axial rattling of the pinion movement unit does not occur even when wear is generated in the shift lever, the stopper, the stopper ring or the ring mounting groove wears, preventing the generation of noise and the generation of damages to the pinion or the ring gear, ensuring a long-term stable operation.

Also according to the pinion shifting arrangement for a starter of the present invention, the elastic member is disposed in the engagement portion between the shift lever and the pinion movement unit, so that the pinion movement unit may be intermittently urged against the stopper by the elasticity of the elastic member even after the action of the compression spring is exhausted. Therefore, the axial ratting of the pinion movement unit can be prevented even after the above-mentioned components are considerably worn.

Further, according to the pinion shifting arrangement for a starter of the present invention, two compression springs are provided so that these two compression springs function to urge the pinion when the pinion is in abutment with the driven gear and that only one of the compression springs functions to urge in the fully moved position in which the pinion is in abutment with the stopper, whereby the pinion can be urged continuously against the stopper with a massive force during the pinion engagement waiting time and with a small force thereafter. Therefore, the sliding movement or the shifting of the pinion movement unit into the fully moved position in which the pinion is in engagement is very quick and smooth and, moreover, the previously described rattling at the fully moved position can be prevented for an extended period of time.

What is claimed is:

1. A pinion shifting arrangement for a starter motor, comprising:

solenoid switch means having a hook which can be pulled in an axial direction by a plunger (10: 43) via compression spring means, including means for electromagnetically actuating the plunger; and a shift lever having one end thereof engaged with said hook and another, opposite end thereof adapted to apply a sliding thrust force to a pinion movement unit slidably mounted on a support shaft and including a pinion engageable with a gear (35) to be driven;

wherein a clearance (34) is provided between an end of the hook and the plunger through which said hook can continue to be pulled by said plunger via said compression spring means even when said pinion is in a fully extended position abutting a stopper (27) and said pinion is in engagement with said gear.

2. A pinion shifting arrangement as claimed in claim 1, wherein an elastic member (26), which is flexed through said shift lever by the force of the compression spring means when said pinion is in the stopper abutting position, is disposed in an engagement portion between said another end of the shift lever and said pinion movement unit.

3. A pinion shifting arrangement as claimed in claim 1, wherein said compression spring means comprises two parallel mounted springs (17,47), both of said springs acting to urge said pinion to engage said gear when said pinion is in abutment with said gear, and only one of said springs acting when said pinion is in the stopper abutting position in which said pinion is in engagement with said driven gear.

* * * * *